US006743758B2

(12) United States Patent
Li et al.

(10) Patent No.: US 6,743,758 B2
(45) **Date of Patent: *Jun. 1, 2004**

(54) LUBRICANT FOR TRANSPORTING CONTAINERS ON A CONVEYOR SYSTEM

(75) Inventors: Minyu Li, Oakdale, MN (US); Keith Darrell Lokkesmoe, Savage, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/287,559

(22) Filed: Nov. 1, 2002

(65) Prior Publication Data

US 2003/0073589 A1 Apr. 17, 2003

Related U.S. Application Data

(63) Continuation of application No. 09/596,599, filed on Jun. 16, 2000, now Pat. No. 6,495,494.

(51) Int. Cl.[7] ..... C10M 139/00; C10M 173/02

(52) U.S. Cl. ..... 508/208; 508/214; 508/485; 508/583

(58) Field of Search ..... 508/208, 209, 508/215

(56) References Cited

U.S. PATENT DOCUMENTS

| | | | | |
|---|---|---|---|---|
| 3,011,975 | A | 12/1961 | Nitzsche et al. | 252/25 |
| 3,213,024 | A | 10/1965 | Blake et al. | 252/33.3 |
| 3,664,956 | A | 5/1972 | Messina et al. | 252/49.6 |
| 3,853,607 | A | 12/1974 | Iyengar et al. | 428/378 |
| 3,981,812 | A | 9/1976 | Zletz | 252/49.6 |
| 4,062,785 | A | 12/1977 | Nibert | 508/211 |
| 4,069,933 | A | 1/1978 | Newing | 215/12.2 |
| 4,149,624 | A | 4/1979 | Douty et al. | 198/500 |
| 4,162,347 | A | 7/1979 | Montgomery | 428/411 |
| 4,248,724 | A | 2/1981 | MacIntosh | 252/49.6 |
| 4,252,528 | A | 2/1981 | Decker et al. | 8/115.6 |
| 4,262,776 | A | 4/1981 | Wilson et al. | 184/15.1 |
| 4,289,671 | A | 9/1981 | Hernandez | 260/28.5 |
| 4,324,671 | A | 4/1982 | Christian et al. | 252/49.6 |
| 4,343,616 | A | 8/1982 | Decker et al. | 8/115.6 |
| 4,420,578 | A | 12/1983 | Hagens et al. | 524/322 |
| 4,436,200 | A | 3/1984 | Hodlewski et al. | 198/851 |
| 4,478,889 | A | 10/1984 | Maruhashi et al. | 427/230 |
| 4,486,378 | A | 12/1984 | Hirata et al. | 264/512 |
| 4,515,836 | A | 5/1985 | Cobbs, Jr. et al. | 427/425 |

(List continued on next page.)

FOREIGN PATENT DOCUMENTS

| | | |
|---|---|---|
| CA | 1157456 A | 11/1983 |
| EP | 0 359 330 | 3/1990 |
| EP | 0 844 299 | 5/1998 |
| GB | 1564128 | 4/1980 |
| JP | 57-003892 | 1/1982 |
| JP | 06-136377 | 5/1994 |
| JP | 10-053679 | 8/1996 |
| JP | 10-059523 | 3/1998 |
| NL | 9300742 | 5/1993 |
| WO | WO 96/08601 | 3/1996 |

OTHER PUBLICATIONS

"Encyclopedia of Chemical Technology, Fourth Edition, Flavor Characterization to Fuel Cells", *John Wiley & Sons*, vol. 11, pp. 621–644 (Date unknown).

(List continued on next page.)

*Primary Examiner*—Ellen M. McAvoy
(74) *Attorney, Agent, or Firm*—IPLM Group, P.A.

(57) ABSTRACT

The passage of a container along a conveyor is lubricated by applying to the container or conveyor a mixture of a water-miscible silicone material and a water-miscible lubricant. The mixture can be applied in relatively low amounts and with relatively low or no water content, to provide thin, substantially non-dripping lubricating films. In contrast to dilute aqueous lubricants, the lubricants of the invention provide drier lubrication of the conveyors and containers, a cleaner conveyor line and reduced lubricant usage, thereby reducing waste, cleanup and disposal problems.

39 Claims, 1 Drawing Sheet

U.S. PATENT DOCUMENTS

| | | | | | |
|---|---|---|---|---|---|
| 4,525,377 | A | | 6/1985 | Nickel et al. | 427/532 |
| 4,534,995 | A | | 8/1985 | Pocock et al. | 427/533 |
| 4,538,542 | A | | 9/1985 | Kennon et al. | 118/302 |
| 4,543,909 | A | | 10/1985 | Sharpless | 118/326 |
| 4,569,869 | A | | 2/1986 | Kushida et al. | 428/35.7 |
| 4,573,429 | A | | 3/1986 | Cobbs, Jr. et al. | 118/322 |
| 4,627,457 | A | | 12/1986 | Bird et al. | 137/1 |
| 4,632,053 | A | | 12/1986 | Villanueva et al. | 118/66 |
| 4,652,386 | A | | 3/1987 | Alberts et al. | 252/49.6 |
| 4,690,299 | A | | 9/1987 | Cannon | 220/592.19 |
| 4,709,806 | A | | 12/1987 | Candle | 198/819 |
| 4,713,266 | A | | 12/1987 | Hasegawa et al. | 427/412.5 |
| 4,714,580 | A | | 12/1987 | Maruhashi et al. | 264/516 |
| 4,719,022 | A | | 1/1988 | Hyde | 252/35 |
| 4,769,162 | A | | 9/1988 | Remus | 508/170 |
| 4,828,727 | A | | 5/1989 | McAninch | 252/11 |
| 4,851,287 | A | | 7/1989 | Hartsing, Jr. | 428/325 |
| 4,874,647 | A | | 10/1989 | Yatsu et al. | 428/35.7 |
| 4,919,984 | A | | 4/1990 | Maruhashi et al. | 428/36.4 |
| 4,929,375 | A | | 5/1990 | Rossio et al. | 252/49.3 |
| 4,980,211 | A | | 12/1990 | Kushida et al. | 428/36.7 |
| 5,001,935 | A | | 3/1991 | Tekkanat et al. | 73/799 |
| 5,009,801 | A | | 4/1991 | Wider et al. | 252/33.2 |
| 5,062,979 | A | | 11/1991 | Scharf et al. | 252/493 |
| 5,073,280 | A | | 12/1991 | Rossio et al. | 252/49.3 |
| 5,115,047 | A | | 5/1992 | Hashimoto et al. | 525/444 |
| 5,139,834 | A | | 8/1992 | Cole | 428/35.8 |
| 5,160,646 | A | | 11/1992 | Scheld | 252/32.5 |
| 5,174,914 | A | | 12/1992 | Gutzmann | 252/34 |
| 5,182,035 | A | | 1/1993 | Schmidt et al. | 252/34 |
| 5,191,779 | A | | 3/1993 | Imaja et al. | 72/46 |
| 5,202,037 | A | | 4/1993 | LaVelle et al. | 508/511 |
| 5,238,718 | A | | 8/1993 | Yano et al. | 428/35.7 |
| 5,320,132 | A | | 6/1994 | Weisse | 137/597 |
| 5,334,322 | A | | 8/1994 | Williams, Jr. | 252/52 A |
| RE34,742 | E | | 9/1994 | Maier et al. | 428/36.5 |
| 5,352,376 | A | | 10/1994 | Gutzmann | 252/49.3 |
| 5,371,112 | A | | 12/1994 | Sayre et al. | 521/48 |
| 5,391,308 | A | | 2/1995 | Despo | 508/164 |
| 5,427,258 | A | | 6/1995 | Krishnakumar et al. | 215/400 |
| 5,474,692 | A | | 12/1995 | Laufenberg et al. | 252/34 |
| 5,486,316 | A | | 1/1996 | Bershas et al. | 252/547 |
| 5,509,965 | A | | 4/1996 | Harry et al. | 118/423 |
| 5,534,172 | A | * | 7/1996 | Perry et al. | 508/156 |
| 5,549,836 | A | | 8/1996 | Moses | 508/183 |
| 5,559,087 | A | | 9/1996 | Halsrud et al. | 508/579 |
| 5,565,127 | A | | 10/1996 | Laufenberg et al. | 508/220 |
| 5,573,819 | A | | 11/1996 | Nugent, Jr. et al. | 428/34.8 |
| 5,652,034 | A | | 7/1997 | Seiner | 428/36.6 |
| 5,658,619 | A | | 8/1997 | Kirschner et al. | 427/512 |
| 5,663,131 | A | | 9/1997 | Winicov et al. | 508/580 |
| 5,672,401 | A | | 9/1997 | Anglin et al. | 428/64.1 |
| 5,681,628 | A | | 10/1997 | Niederst et al. | 428/35.7 |
| 5,688,747 | A | | 11/1997 | Khan et al. | 508/208 |
| 5,698,269 | A | | 12/1997 | Carlblom et al. | 427/475 |
| 5,698,498 | A | | 12/1997 | Luciani et al. | 508/193 |
| 5,721,023 | A | | 2/1998 | Ostapchenko | 428/35.2 |
| 5,723,418 | A | | 3/1998 | Person Hei et al. | 508/511 |
| 5,728,770 | A | | 3/1998 | Yamamoto et al. | 524/755 |
| 5,747,430 | A | | 5/1998 | Matsushita et al. | 508/209 |
| 5,747,431 | A | | 5/1998 | Taylour et al. | 508/283 |
| 5,783,303 | A | | 7/1998 | Tsuei | 428/354 |
| 5,789,459 | A | | 8/1998 | Inagaki et al. | 522/16 |
| 5,863,874 | A | | 1/1999 | Person Hei et al. | 508/521 |
| 5,869,436 | A | | 2/1999 | Lindman | 508/174 |
| 5,876,812 | A | | 3/1999 | Frisk et al. | 428/35.7 |
| 5,925,601 | A | | 7/1999 | McSherry | 508/425 |
| 5,935,914 | A | | 8/1999 | Theyssen et al. | 508/517 |
| 6,060,444 | A | | 5/2000 | Schulz et al. | 510/451 |
| 6,087,308 | A | | 7/2000 | Butler et al. | 508/486 |
| 6,207,622 | B1 | | 3/2001 | Li et al. | 508/208 |
| 6,214,777 | B1 | | 4/2001 | Li et al. | 508/388 |
| 6,288,012 | B1 | | 9/2001 | Li et al. | 508/113 |
| 6,302,263 | B1 | | 10/2001 | Bennett et al. | 198/495 |
| 6,310,013 | B1 | | 10/2001 | Lokkesmoe et al. | 508/502 |
| 6,423,303 | B1 | * | 7/2002 | Ryklin et al. | 508/208 |
| 6,427,826 | B1 | * | 8/2002 | Li et al. | 508/113 |
| 6,495,494 | B1 | * | 12/2002 | Li et al. | 508/206 |
| 6,509,302 | B2 | * | 1/2003 | Li et al. | 508/208 |

OTHER PUBLICATIONS

Interflon®, http://www.interflon.nl/engels.htm, last updated Jun. 18, 1999, pp. 1–10.

Interflon® "Fin Food Lube Al" Brochure, 20 pgs., (Date unknown).

Du Pont Krytox® Brochure, "Krytox® Dry Film Lubricants", pp. 1–6 (Nov. 1997).

Synco Chemical Corporation, http://www.super–tube.com, last updated May 5, 1999, 5 pgs.

Moskala, E., "Environmental Stress Cracking in PET Beverage Containers", pp. 8–1–8–15 (1996).

JohnsonDiversey Food Group Duplicate Invoice for Dicolube TP dated May 9, 1996.

DiverseyLever Core–Euro Formulation dated Jun. 1, 2000 (2 pgs).

Material Safety Data Sheet for Dicolube TP dated Apr. 11, 1996 (1 pg.).

"A fracture mechanics approach to environmental stress cracking in poly(ethyleneterephthalate)," *Polymer*, vol. 39 No. 3, pp. 75–80 (1998).

"The Alternative to Soap and Water for Lubricating Conveyor Lines," *Food & Drink Business*, pp. 35–36 (Jan. 1998).

"Environmental Stress Cracking in PET Carbonated Soft Drink Containers," Eric J. Moskala, Ph.D., Eastman Chemical Company, presented at Bev Tech 98 (Savannah, GA).

"Environmental Stress Cracking Resistance of Blow Molded Poly(Ethylene Terephthalate) Containers," *Polymer Engineering and Science*, vol. 32, No. 6, pp. 393–399 (Mar. 1992).

Lubrication and Lubricants, *Encyclopedia of Chemical Technology*, vol. 15, pp. 463–517.

Material Safety Data Sheet for Lubostar CP (May 3, 2000).

* cited by examiner

LUBRICANT FOR TRANSPORTING CONTAINERS ON A CONVEYOR SYSTEM

CROSS-REFERENCE TO RELATED APPLICATION

This application is a continuation of application Ser. No. 09/596,599 filed on Jun. 16, 2000 now U.S. Pat. No. 6,495,494.

TECHNICAL FIELD

This invention relates to conveyor lubricants and to a method for conveying articles. The invention also relates to conveyor systems and containers wholly or partially coated with such lubricant compositions.

BACKGROUND ART

In commercial container filling or packaging operations, the containers typically are moved by a conveying system at very high rates of speed. Copious amounts of aqueous dilute lubricant solutions (usually based on fatty acid amines) are typically applied to the conveyor or containers using spray or pumping equipment. These lubricant solutions permit high-speed operation of the conveyor and limit marring of the containers or labels, but also have some disadvantages. For example, aqueous conveyor lubricants based on fatty amines typically contain ingredients that can react with spilled carbonated beverages or other food or liquid components to form solid deposits. Formation of such deposits on a conveyor can change the lubricity of the conveyor and require shutdown to permit cleanup. Some aqueous conveyor lubricants are incompatible with thermoplastic beverage containers made of polyethylene terephthalate (PET) and other plastics, and can cause environmental stress cracking (crazing and cracking that occurs when the plastic polymer is under tension) in plastic containers. Dilute aqueous lubricants typically require use of large amounts of water on the conveying line, which must then be disposed of or recycled, and which causes an unduly wet environment near the conveyor line. Moreover, some aqueous lubricants can promote the growth of microbes.

SUMMARY OF THE INVENTION

The present invention provides, in one aspect, a method for lubricating the passage of a container along a conveyor comprising applying a mixture of a water-miscible silicone material and a water-miscible lubricant to at least a portion of the container-contacting surface of the conveyor or to at least a portion of the conveyor-contacting surface of the container.

The present invention provides, in another aspect, a lubricated conveyor or container, having a lubricant coating on a container-contacting surface of the conveyor or on a conveyor-contacting surface of the container, wherein the coating comprises a mixture of a water-miscible silicone material and a water-miscible lubricant.

The invention also provides conveyor lubricant compositions comprising a mixture of a water-miscible silicone material and a water-miscible lubricant.

The compositions used in the invention can be applied in relatively low amounts and do not require in-line dilution with significant amounts of water. The compositions of the invention provide thin, substantially non-dripping lubricating films. In contrast to dilute aqueous lubricants, the lubricants of the invention provide drier lubrication of the conveyors and containers, a cleaner and drier conveyor line and working area, and reduced lubricant usage, thereby reducing waste, cleanup and disposal problems.

DETAILED DESCRIPTION

Figure 1:
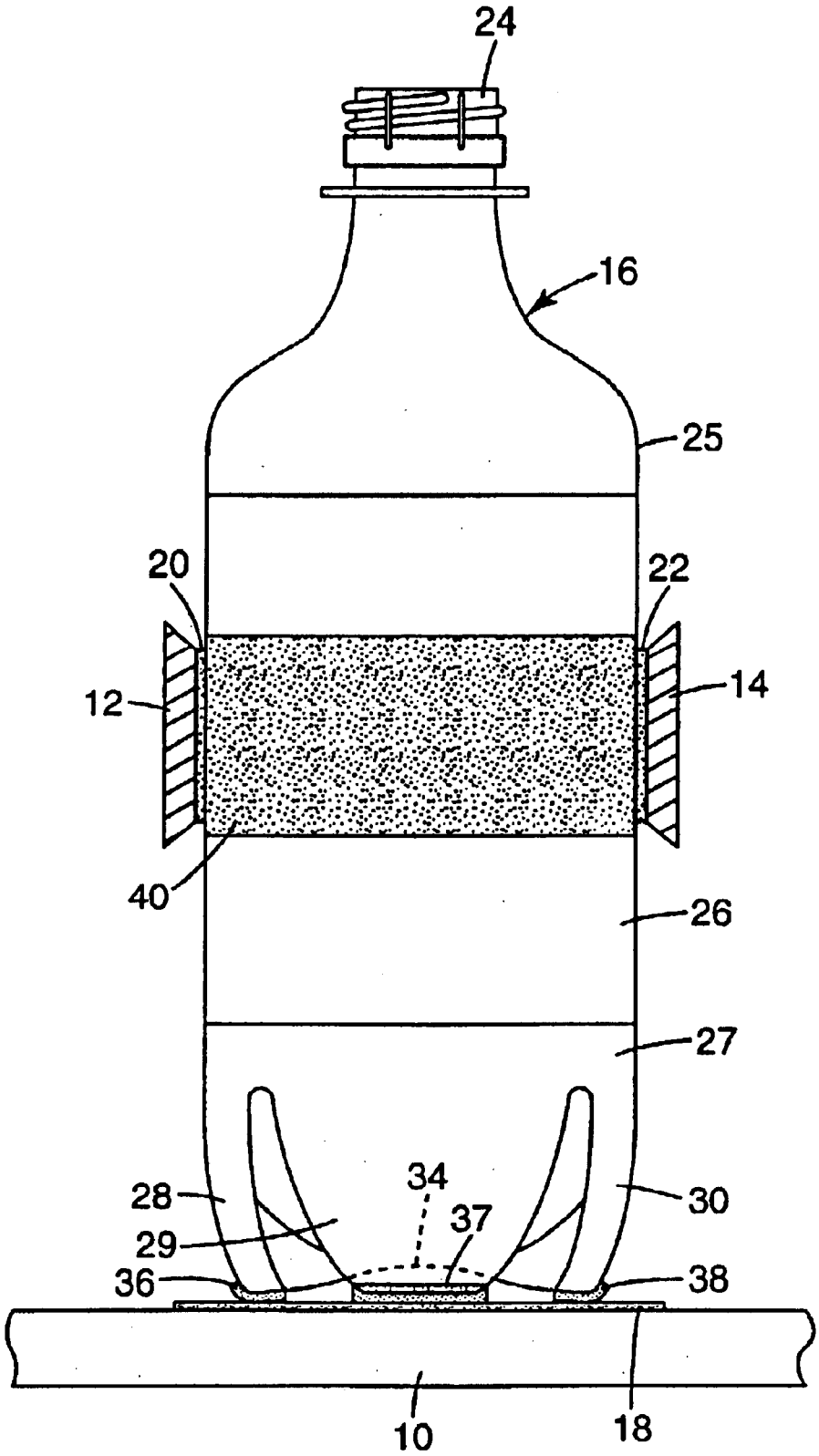
FIG. 1 illustrates in partial cross-section a side view of a plastic beverage container and conveyor partially coated with a lubricant composition of the invention.

The invention provides a lubricant coating that reduces the coefficient of friction of coated conveyor parts and containers and thereby facilitates movement of containers along a conveyor line. The lubricant compositions used in the invention can optionally contain water or a hydrophilic diluent, as a component or components in the lubricant composition as sold or added just prior to use. The lubricant composition does not require in-line dilution with significant amounts of water, that is, it can be applied undiluted or with relatively modest dilution, e.g., at a water:lubricant ratio of about 1:1 to 5:1. In contrast, conventional dilute aqueous lubricants are applied using significant amounts of water, at dilution ratios of about 100:1 to 500:1. The lubricant compositions preferably provide a renewable coating that can be reapplied, if desired, to offset the effects of coating wear. They preferably can be applied while the conveyor is at rest or while it is moving, e.g., at the conveyor's normal operating speed. Preferably the lubricant coating is water-based cleaning agent-removable, that is, it preferably is sufficiently soluble or dispersible in water so that the coating can be removed from the container or conveyor using conventional aqueous cleaners, without the need for high pressure, mechanical abrasion or the use of aggressive cleaning chemicals. The lubricant coating preferably is substantially non-dripping, that is, preferably the majority of the lubricant remains on the container or conveyor following application until such time as the lubricant may be deliberately washed away.

The invention is further illustrated in FIG. 1, which shows a conveyor belt 10, conveyor chute guides 12, 14 and beverage container 16 in partial cross-sectional view. The container-contacting portions of belt 10 and chute guides 12, 14 are coated with thin layers 18, 20 and 22 of a lubricant composition of the invention. Container 16 is constructed of blow-molded PET, and has a threaded end 24, side 25, label 26 and base portion 27. Base portion 27 has feet 28, 29 and 30, and crown portion (shown partially in phantom) 34. Thin layers 36, 37 and 38 of a lubricant composition of the invention cover the conveyor-contacting portions of container 16 on feet 28, 29 and 30, but not crown portion 34. Thin layer 40 of a lubricant composition of the invention covers the conveyor-contacting portions of container 16 on label 26.

The silicone material and hydrophilic lubricant are "water-miscible", that is, they are sufficiently water-soluble or water-dispersible so that when added to water at the desired use level they form a stable solution, emulsion or suspension. The desired use level will vary according to the particular conveyor or container application, and according to the type of silicone and hydrophilic lubricant employed.

A variety of water-miscible silicone materials can be employed in the lubricant compositions, including silicone emulsions (such as emulsions formed from methyl (dimethyl), higher alkyl and aryl silicones; functionalized silicones such as chlorosilanes; amino-, methoxy-, epoxy- and vinyl-substituted siloxanes; and silanols). Suitable silicone emulsions include E2175 high viscosity polydimethylsiloxane (a 60% siloxane emulsion commercially available from Lambent Technologies, Inc.), E21456 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30–60% siloxane emulsion commercially available from Dow Corning Corporation), SM2135 polydimethylsiloxane (a nonionic 50% siloxane emulsion commercially available from GE Silicones) and SM2167 polydimethylsiloxane (a cationic 50% siloxane emulsion commercially available from GE Silicones. Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from about 30 wt. % to about 70 wt. % water. Non-water-miscible silicone materials (e.g., non-water-soluble silicone fluids and non-water-dispersible silicone powders) can also be employed in the lubricant if combined with a suitable emulsifier (e.g., nonionic, anionic or cationic emulsifiers). For applications involving plastic containers (e.g., PET beverage bottles), care should be taken to avoid the use of emulsifiers or other surfactants that promote environmental stress cracking in plastic containers when evaluated using the PET Stress Crack Test set out below. Polydimethylsiloxane emulsions are preferred silicone materials. Preferably the lubricant composition is substantially free of surfactants aside from those that may be required to emulsify the silicone compound sufficiently to form the silicone emulsion.

A variety of water-miscible lubricants can be employed in the lubricant compositions, including hydroxy-containing compounds such as polyols (e.g., glycerol and propylene glycol); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable water-miscible lubricants include phosphate esters, amines and their derivatives, and other commercially available water-miscible lubricants that will be familiar to those skilled in the art. Derivatives (e.g., partial esters or ethoxylates) of the above lubricants can also be employed. For applications involving plastic containers, care should be taken to avoid the use of water-miscible lubricants that might promote environmental stress cracking in plastic containers when evaluated using the PET Stress Crack Test set out below. Preferably the water-miscible lubricant is a polyol such as glycerol.

If water is employed in the lubricant compositions, preferably it is deionized water. Suitable hydrophilic diluents include alcohols such as isopropyl alcohol. For applications involving plastic containers, care should be taken to avoid the use of water or hydrophilic diluents containing contaminants that might promote environmental stress cracking in plastic containers when evaluated using the PET Stress Crack Test set out below.

Preferred amounts for the silicone material, hydrophilic lubricant and optional water or hydrophilic diluent are about 0.05 to about 12 wt. % of the silicone material (exclusive of any water or other hydrophilic diluent that may be present if the silicone material is, for example, a silicone emulsion), about 30 to about 99.95 wt. % of the hydrophilic lubricant, and 0 to about 69.95 wt. % of water or hydrophilic diluent. More preferably, the lubricant composition contains about 0.5 to about 8 wt. % of the silicone material, about 50 to about 90 wt. % of the hydrophilic lubricant, and about 2 to about 49.5 wt. % of water or hydrophilic diluent. Most preferably, the lubricant composition contains about 0.8 to about 4 wt. % of the silicone material, about 65 to about 85 wt. % of the hydrophilic lubricant, and about 11 to about 34.2 wt. % of water or hydrophilic diluent.

The lubricant compositions can contain additional components if desired. For example, the compositions can contain adjuvants such as conventional waterborne conveyor lubricants (e.g., fatty acid lubricants), antimicrobial agents, colorants, foam inhibitors or foam generators, cracking inhibitors (e.g., PET stress cracking inhibitors), viscosity modifiers, film forming materials, antioxidants or antistatic agents. The amounts and types of such additional components will be apparent to those skilled in the art.

For applications involving plastic containers, the lubricant compositions preferably have a total alkalinity equivalent to less than about 100 ppm $CaCO_3$, more preferably less than about 50 ppm $CaCO_3$, and most preferably less than about 30 ppm $CaCO_3$, as measured in accordance with Standard Methods for the Examination of Water and Wastewater, $18^{th}$ Edition, Section 2320, Alkalinity.

The lubricant compositions preferably have a coefficient of friction (COF) that is less than about 0.14, more preferably less than about 0.1, when evaluated using the Short Track Conveyor Test described below.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRAPACK™ boxes), cans, bottles and the like. Although any desired portion of the container can be coated with the lubricant composition, the lubricant composition preferably is applied only to parts of the container that will come into contact with the conveyor or with other containers. Preferably, the lubricant composition is not applied to portions of thermoplastic containers that are prone to stress cracking. In a preferred embodiment of the invention, the lubricant composition is applied to the crystalline foot portion of a blow-molded, footed PET container (or to one or more portions of a conveyor that will contact such foot portion) without applying significant quantities of lubricant composition to the amorphous center base portion of the container. Also, the lubricant composition preferably is not applied to portions of a container that might later be gripped by a user holding the container, or, if so applied, is preferably removed from such portion prior to shipment and sale of the container. For some such applications the lubricant composition preferably is applied to the conveyor rather than to the container, in order to limit the extent to which the container might later become slippery in actual use.

The lubricant composition can be a liquid or semi-solid at the time of application. Preferably the lubricant composition is a liquid having a viscosity that will permit it to be pumped and readily applied to a conveyor or containers, and that will facilitate rapid film formation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by pumping, spraying or brushing the lubricant composition. This behavior can be brought about by, for example, including appropriate types and amounts of thixotropic fillers (e.g., treated or untreated fumed silicas) or other rheology modifiers in the lubricant composition. The lubricant coating can be applied in a constant or intermittent fashion. Preferably, the lubricant coating is applied in an intermittent fashion in order to minimize the amount of applied lubricant composition. For example, the lubricant composition can be applied for a period of time during which at least one complete revolution of the conveyor takes place. Application of the lubricant composition can then be halted for a period of time (e.g., minutes or hours) and then resumed for a further period of time (e.g., one or more further conveyor revolutions). The lubricant coating should be sufficiently thick to provide the desired degree of lubrication, and sufficiently thin to permit economical operation and to discourage drip formation. The lubricant coating thickness preferably is maintained at at least about 0.0001 mm, more preferably about 0.001 to about 2 mm, and most preferably about 0.005 to about 0.5 mm.

Application of the lubricant composition can be carried out using any suitable technique including spraying, wiping, brushing, drip coating, roll coating, and other methods for application of a thin film. If desired, the lubricant composition can be applied using spray equipment designed for the application of conventional aqueous conveyor lubricants, modified as need be to suit the substantially lower application rates and preferred non-dripping coating characteristics of the lubricant compositions used in the invention. For example, the spray nozzles of a conventional beverage container lube line can be replaced with smaller spray nozzles or with brushes, or the metering pump can be altered to reduce the metering rate.

The lubricant compositions can if desired be evaluated using a Short Track Conveyor Test and a PET Stress Crack Test.

Short Track Conveyor Test

A conveyor system employing a motor-driven 83 mm wide by 6.1 meter long REXNORD™ LF polyacetal thermoplastic conveyor belt is operated at a belt speed of 30.48 meters/minute. Six 2-liter filled PET beverage bottles are stacked in an open-bottomed rack and allowed to rest on the moving belt. The total weight of the rack and bottles is 16.15 Kg. The rack is held in position on the belt by a wire affixed to a stationary strain gauge. The force exerted on the strain gauge during belt operation is recorded using a computer. A thin, even coat of the lubricant composition is applied to the surface of the belt using an applicator made from a conventional bottle wash brush. The belt is allowed to run for 25 to 90 minutes during which time a consistently low COF is observed. The COF is calculated on the basis of the measured force and the mass of the bottles, averaged over the run duration.

PET Stress Crack Test

Standard 2-liter PET beverage bottles (commercially available from Constar International) are charged with 1850 g of chilled water, 31.0 g of sodium bicarbonate and 31.0 g of citric acid. The charged bottle is capped, rinsed with deionized water and set on clean paper towels overnight. The bottoms of 12 bottles are dipped in a 200 g sample of the undiluted lube in a 125×65 mm crystal dish, then placed in a bin and stored in an environmental chamber at 37.8° C., 90% relative humidity for 14 days. The bottles are removed from the chamber, observed for crazes, creases and crack patterns on the bottom. The aged bottles are compared with 12 control bottles that were exposed to a standard dilute aqueous lubricant (LUBODRIVE™ RX, commercially available from Ecolab) prepared as follows. A 1.7 wt. % solution of the LUBODRIVE lubricant (in water containing 43 ppm alkalinity as $CaCO_3$) was foamed for several minutes using a mixer. The foam was transferred to a lined bin and the control bottles were dipped in the foam. The bottles were then aged in the environmental chamber as outlined above.

The invention can be better understood by reviewing the following examples. The examples are for illustration purposes only, and do not limit the scope of the invention.

EXAMPLE 1

77.2 parts of a 96 wt. % glycerol solution, 20.7 parts deionized water, and 2.1 parts E2175 high viscosity polydimethylsiloxane (60% siloxane emulsion commercially available from Lambent Technologies, Inc.) were combined with stirring until a uniform mixture was obtained. The resulting lubricant composition was slippery to the touch and readily could be rinsed from surfaces using a plain water wash. Using the Short Track Conveyor Test, about 20 g of the lubricant composition was applied to the moving belt over a 90 minute period. The observed COF was 0.062. In a comparison Short Track Conveyor test performed using a dilute aqueous solution of a standard conveyor lubricant (LUBODRIVE™ RX, commercially available from Ecolab, applied using a 0.5% dilution in water and about an 8 liter/hour spray application rate), the observed COF was 0.126, thus indicating that the lubricant composition of the invention provided reduced sliding friction.

The lubricant composition of Example 1 was also evaluated using the PET Stress Crack Test. The aged bottles exhibited infrequent small, shallow crazing marks. For the comparison dilute aqueous lubricant, frequent medium depth crazing marks and infrequent deeper crazing marks were observed. No bottles leaked or burst for either lubricant, but the bottoms of bottles lubricated with a lubricant composition of the invention had a better visual appearance after aging.

EXAMPLE 2

Using the method of Example 1, 77.2 parts of a 96 wt. % glycerol solution, 20.7 parts deionized water, and 2.1 parts HV490 high molecular weight hydroxy-terminated dimethyl silicone (anionic 30–60% siloxane emulsion commercially available from Dow Corning Corporation) were combined with stirring until a uniform mixture was obtained. The resulting lubricant composition was slippery to the touch and readily could be rinsed from surfaces using a plain water wash. Using the Short Track Conveyor Test, about 20 g of the lubricant composition was applied to the moving belt over a 15 minute period. The observed COF was 0.058.

EXAMPLE 3

Using the method of Example 1, 75.7 parts of a 96 wt. % glycerol solution, 20.3 parts deionized water, 2.0 parts HV490 high molecular weight hydroxy-terminated dimethyl silicone (anionic 30–60% siloxane emulsion commercially available from Dow Coming Corporation) and 2.0 parts GLUCOPON™ 220 alkyl polyglycoside surfactant (commercially available from Henkel Corporation) were combined with stirring until a uniform mixture was obtained. The resulting lubricant composition was slippery to the touch and readily could be rinsed from surfaces using a plain water wash. Using the Short Track Conveyor Test, about 20 g of the lubricant composition was applied to the moving belt over a 15 minute period. The observed COF was 0.071.

EXAMPLE 4

Using the method of Example 1, 72.7 parts of a 99.5 wt. % glycerol solution, 23.3 parts deionized water, 2 parts HV495 silicone emulsion (commercially available from Dow Coming Corporation) and 2 parts GLUCOPON™ 220 alkyl polyglycoside surfactant (commercially available from Henkel Corporation) were combined with stirring until a uniform mixture was obtained. The resulting lubricant composition was slippery to the touch and readily could be rinsed from surfaces using a plain water wash. However, the presence of the surfactant caused an increase in stress cracking in the PET Stress Crack Test.

Various modifications and alterations of this invention will be apparent to those skilled in the art without departing from the scope and spirit of the invention, and are intended to be within the scope of the following claims.

We claim:

1. A concentrate comprising a mixture of (i) at least about 0.8 wt. % of a water-miscible silicone material and (ii) a water-miscible lubricant comprising a polyalkylene-glycol or hydroxyl-containing derivative of a polyalkylene glycol, the concentrate providing a conveyor and container lubricant when diluted with water.

2. A concentrate according to claim 1 essentially of the water-miscible silicone material and water-miscible lubricant.

3. A concentrate according to claim 1 consisting of the water-miscible silicone material, water-miscible lubricant and water.

4. A concentrate according to claim 1 comprising about 0.8 to about 4 wt. % of the water-miscible silicone material.

5. A concentrate according to claim 1 wherein the water-miscible silicone material comprises a silicone emulsion.

6. A concentrate according to claim 5 that is sufficiently free of surfactants so as not to cause an increase in stress cracking in a PET Stress Crack Test compared to a concentrate made without such surfactants aside from those that may be required to emulsify the silicone material sufficiently to form the silicone emulsion.

7. A concentrate according to claim 1 wherein the water-miscible lubricant comprises a polyalkylene glycol.

8. A concentrate according to claim 7 wherein the water-miscible lubricant comprises a derivative of a polyalkylene glycol.

9. A concentrate according to claim 8 wherein the water-miscible lubricant comprises a partial ester of a polyalkylene glycol.

10. A concentrate according to claim 8 wherein the water-miscible lubricant comprises an ethoxylate of a polyalkylene glycol.

11. A concentrate according to claim 1 further comprising an antimicrobial agent.

12. A concentrate according to claim 1 having a total alkalinity equivalent to less than about 100 ppm $CaCO_3$.

13. A concentrate according to claim 1 having a total alkalinity equivalent to less than about 30 ppm $CaCO_3$.

14. A conveyor and container lubricant composition comprising a mixture of water and a concentrate according to claim 1.

15. A composition according to claim 14 wherein the amounts of the water-miscible silicone material and the water-miscible lubricant are at use levels that (i) reduce the coefficient of friction between a polyacetal thermoplastic conveyor belt and blow-molded polyethylene terephthalate containers to less than about 0.14 and (ii) facilitate movement of such containers along a container filling line.

16. A composition according to claim 14 having a coefficient of friction less than about 0.14 when evaluated using a Short Track Conveyor Test.

17. A composition according to claim 14 having a coefficient of friction between about 0.058 and about 0.126 when evaluated using a Short Track Conveyor Test.

18. A composition according to claim 14 having a coefficient of friction less than about 0.1 when evaluated using a Short Track Conveyor Test.

19. A water-miscible concentrate comprising a mixture of (i) at least about 0.5 wt. % polydimethylsiloxane and (ii) a polyalkylene glycol or hydroxyl-containing derivative of a polyalkylene glycol, the concentrate providing a conveyor and container lubricant when diluted with water.

20. A concentrate according to claim 19 consisting essentially of the polydimethylsiloxane and the polyalkylene glycol or derivative.

21. A concentrate according to claim 19 consisting of the polydimethylsiloxane, the polyalkylene glycol or derivative, one or more surfactants that emulsify the polydimethylsiloxane, and water.

22. A concentrate according to claim 19 comprising about 0.5 to about 8 wt % polydimethylsiloxane.

23. A concentrate according to claim 19 comprising at least about 0.8 wt. % polydimethylsiloxane.

24. A concentrate according to claim 19 comprising about 0.8 to about 4 wt. % polydimethylsiloxane.

25. A concentrate according to claim 19 that is sufficiently free of surfactants so as not to cause an increase in stress cracking in a PET Stress Crack Test compared to a concentrate made without such surfactants aside from those that may be required to emulsify the polydimethylsiloxane sufficiently to form a silicone emulsion.

26. A concentrate according to claim 19 wherein the water-miscible lubricant comprises a polyalkylene glycol.

27. A concentrate according to claim 26 wherein the water-miscible lubricant comprises a derivative of a polyalkylene glycol.

28. A concentrate according to claim 27 wherein the water-miscible lubricant comprises a partial ester of a polyalkylene glycol.

29. A concentrate according to claim 27 wherein the water-miscible lubricant comprises an ethoxylate of a polyalkylene glycol.

30. A concentrate according to claim 19 further comprising an antimicrobial agent.

31. A concentrate according to claim 19 having a total alkalinity equivalent to less than about 100 ppm $CaCO_3$.

32. A concentrate according to claim 19 having a total alkalinity equivalent to less than about 30 ppm $CaCO_3$.

33. A conveyor and container lubricant composition comprising a mixture of water and a concentrate according to claim 19.

34. A composition according to claim 33 wherein the amounts of the polydimethylsiloxane and the polyalkylene glycol or derivative are at use levels that (i) reduce the coefficient of friction between a polyacetal thermoplastic conveyor belt and blow-molded polyethylene terephthalate containers to less than about 0.14 and (ii) facilitate movement of such containers along a container filling line.

35. A composition according to claim 33 having a coefficient of friction less than about 0.14 when evaluated using a Short Track Conveyor Test.

36. A composition according to claim 33 having a coefficient of friction between about 0.058 and about 0.126 when evaluated using a Short Track Conveyor Test.

37. A composition according to claim 33 having a coefficient of friction less than about 0.1 when evaluated using a Short Track Conveyor Test.

38. A conveyor and container lubricant composition comprising a mixture of water and a concentrate suitable for dilution with water, wherein the concentrate consists essentially of a mixture of (i) at least about 0.8 wt. % of a water-miscible silicone material and (ii) a water-miscible lubricant comprising a polyalkylene glycol or hydroxyl-containing derivative of a polyalkylene glycol and the composition has a coefficient of friction between about 0.058 and about 0.126 when evaluated using a Short Track Conveyor Test.

39. A conveyor and container lubricant composition comprising a mixture of water and a concentrate suitable for dilution with water, wherein the concentrate consists essentially of a mixture of (i) at least about 0.5 wt. % of a polydimethylsiloxane and (ii) a water-miscible lubricant comprising a polyalkylene glycol or hydroxyl-containing derivative of a polyalkylene glycol and the composition has a coefficient of friction between about 0.058 and about 0.126 when evaluated using a Short Truck Conveyor Test.

* * * * *

UNITED STATES PATENT AND TRADEMARK OFFICE

CERTIFICATE OF CORRECTION

PATENT NO. : 6,743,758 B2 
DATED : June 1, 2004
INVENTOR(S) : Minyu Li and Keith Darrell Lokkesmoe It is certified that error appears in the above-identified patent and that said Letters Patent is hereby corrected as shown below:

Column 7,
Line 50, after "claim 1" insert -- consisting --.

Signed and Sealed this

Thirtieth Day of November, 2004

JON W. DUDAS
*Director of the United States Patent and Trademark Office*